US008360276B2

(12) United States Patent
Rogier et al.

(10) Patent No.: US 8,360,276 B2
(45) Date of Patent: Jan. 29, 2013

(54) MANUAL INFLATOR WITH CYLINDER CONNECTOR AND STATUS INDICATOR

(75) Inventors: Stephen J. Rogier, Palm Harbor, FL (US); Lyman W. Fawcett, Jr., St. Petersburg, FL (US); Alan D. King, Lakewood Ranch, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 422 days.

(21) Appl. No.: 12/761,351

(22) Filed: Apr. 15, 2010

(65) Prior Publication Data

US 2011/0000550 A1 Jan. 6, 2011

Related U.S. Application Data

(60) Provisional application No. 61/226,131, filed on Jul. 16, 2009, provisional application No. 61/169,713, filed on Apr. 15, 2009.

(51) Int. Cl.

| | |
|---|---|
| ***B67D 7/00*** | (2010.01) |
| ***B67D 7/22*** | (2010.01) |
| ***F16K 15/20*** | (2006.01) |
| ***F16K 33/00*** | (2006.01) |
| ***B63C 9/19*** | (2006.01) |
| ***B63C 9/125*** | (2006.01) |
| ***B63C 9/15*** | (2006.01) |

(52) U.S. Cl. ..... 222/5; 137/68.18; 137/227; 137/318; 137/559; 222/47; 441/93; 441/94

(58) Field of Classification Search ..... 137/68.18, 137/227, 559; 222/5, 47; 441/93, 94
See application file for complete search history.

(56) References Cited

U.S. PATENT DOCUMENTS

| | | | | |
|---|---|---|---|---|
| 3,059,814 | A | 10/1962 | Poncel et al. | |
| 3,091,782 | A | 6/1963 | Sclafani | |
| 3,426,492 | A | 2/1969 | Fork | |
| 3,579,964 | A | 5/1971 | Ohlstein | |
| 3,702,014 | A | 11/1972 | Rabon et al. | |
| 3,757,371 | A | 9/1973 | Martin | |
| 3,809,288 | A | 5/1974 | Mackal | |
| 3,910,457 | A | 10/1975 | Sutliff et al. | |
| 3,997,079 | A | 12/1976 | Niemann | |
| 4,223,805 | A * | 9/1980 | Mackal | 222/5 |
| 4,260,075 | A | 4/1981 | Mackal | |
| 4,267,944 | A | 5/1981 | Mackal | |
| 4,382,231 | A | 5/1983 | Miller | |
| 4,436,159 | A | 3/1984 | Revay | |
| 4,513,248 | A | 4/1985 | Miller | |
| 4,627,823 | A | 12/1986 | Mackal | |
| 5,035,345 | A * | 7/1991 | Janko et al. | 222/5 |
| 5,076,468 | A | 12/1991 | Mackal | |
| 5,400,922 | A * | 3/1995 | Weinheimer et al. | 222/5 |
| 5,694,986 | A * | 12/1997 | Weinheimer et al. | 141/19 |
| 5,775,358 | A | 7/1998 | Fawcett, Jr. et al. | |
| 5,852,986 | A * | 12/1998 | Mackal | 116/266 |
| 6,589,087 | B2 * | 7/2003 | Mackal et al. | 441/93 |
| 6,655,316 | B2 * | 12/2003 | Kerger et al. | 116/277 |
| 7,056,179 | B2 | 6/2006 | Courtney | |
| 2008/0000926 | A1 * | 1/2008 | Wang | 222/5 |

* cited by examiner

*Primary Examiner* — Stephen M Hepperle
*Assistant Examiner* — Daphne M Barry
(74) *Attorney, Agent, or Firm* — Gray Robinson, P.A.

(57) ABSTRACT

A manual inflator having a status indicator that indicates whether a fully-charged, unspent gas cylinder has been installed on the inflator. The status indicator comprises a "single point" indicator having an indicator window that displays the color "green" when the automatic inflator is fully operational or the color "red" when the inflator is at least partially inoperable automatically due to the removal of the gas cylinder or due to the firing of the inflator resulting in a spent gas cylinder.

19 Claims, 11 Drawing Sheets

MANUAL INFLATOR WITH CYLINDER CONNECTOR AND STATUS INDICATOR

CROSS-REFERENCE TO RELATED APPLICATIONS

This application claims the benefit of provisional patent applications Ser. Nos. 61/226,131 filed Jul. 16, 2009 and 61/169,713 filed Apr. 15, 2009, the disclosures of which are hereby incorporated by reference herein.

BACKGROUND OF THE INVENTION

1. Field of the Invention

This invention relates to inflators for inflating articles such as life rafts, life vests, and the like. More particularly, this invention relates to inflators having indicators that indicate the operating condition of the inflator.

2. Description of the Background Art

Presently, there exist many types of inflators designed to inflate inflatable articles such as personal floatation devices (life vests, rings and horseshoes), life rafts, buoys and emergency signaling equipment. Inflators typically comprise a body for receiving the neck of a cylinder of compressed gas such as carbon dioxide. A reciprocating pierce pin is disposed within the body of the inflator for piercing the frangible seal of the gas cylinder whereupon the compressed gas therein flows into an exhaust manifold of the inflator and then into the article to be inflated. Typically, a manually movable firing lever is operatively connected to the pierce pin such that the pierce pin pierces the frangible seal of the gas cylinder upon jerking of a ball lanyard. U.S. Pat. No. 3,809,288, the disclosure of which is hereby incorporated by reference herein, illustrates one particular embodiment of a manual inflator.

There also exist many types of automatic inflators designed to automatically inflate the inflatable article upon submersion in water. In this way, during an emergency situation such as a downed aviator, injured person, or man overboard, the inflatable article automatically inflates thereby alleviating the need for the person to manually activate the inflator. Representative automatic actuators for inflators are disclosed in U.S. Pat. Nos. 3,059,814; 3,091,782; 3,426,942; 3,579,964; 3,702,014; 3,757,371; 3,910,457; 3,997,079; 4,233,805; 4,267,944; 4,260,075; 4,382,231; 4,436,159; 4,513,248; 4,627,823; and 5,076,468, the disclosures of each of which are hereby incorporated by reference herein.

The above-referenced manual and automatic inflators have been successfully commercialized in many industries. In the marine industry, for example, automatic inflators are commonly incorporated into personal floatation devices, life rafts, buoys, emergency signaling equipment, and the like. Because of the nature of such devices, the reliability of the automatic inflator to work properly during exigent circumstances is paramount. Unfortunately, devices intended to be used during emergency situations are often stored away, such as in a locker, hold, or well of a boat, and ignored for inordinate periods of time. Further, when eventually removed from storage for maintenance, such emergency devices are commonly inspected and serviced only by yachtsmen and boaters who lack any specialized training or expertise in servicing inflators. Consequently, inflators may be improperly serviced by inadvertently installing a spent gas cylinder or in the case of an automatic inflator, by inadvertently installing a spent bobbin. Obviously, an inflator that has been improperly serviced, will fail to properly operate during an emergency situation.

Various safety indicators have been developed for indicating the operating condition of inflators and gas cylinders used in connection therewith. For example, as disclosed in U.S. Pat. No. 5,775,358, the disclosure of which is hereby incorporated by reference herein, there exists an indicator system that interconnects between the gas cylinder and the inflator. The one-time, disposable indicator system is responsive to the high pressure release of gas from the gas cylinder during a discharge and changes from a color "green" signifying the gas cylinder being charged to a color "red" signifying that the gas cylinder has been discharged. As taught by U.S. Pat. No. 5,694,986, the disclosure of which is hereby incorporated by reference herein, status indicators have also been incorporated within automatic actuators for indicating when the automatic actuator is in its "cocked" position armed and ready for firing and when the automatic actuator has been fired. The status indicator incorporated into the automatic inflator as taught by this patent, indicates the existence of or the ready-condition or status of the bobbin within the automatic inflator. However, it is incapable of indicating the charged condition of the gas cylinder.

It should be appreciated that the gas cylinder indicator of U.S. Pat. No. 5,775,358 and the automatic actuator status indicator of U.S. Pat. No. 5,694,986 may be used together with the former indicating the spent condition of the gas cylinder and the latter indicating the spent condition of the bobbin of the automatic actuator. However, it should also be appreciated that the gas cylinder indicator may be indicating "green" representing a fully charged gas cylinder whereas the automatic inflator indicator may be indicating "red" representative of a spent bobbin. Conversely, the gas cylinder indicator may be indicating "red" and the automatic inflator indicator may be indicating "green". Of course, the automatic inflator indicator could be displaying "green" even when the gas cylinder is missing entirely. In such scenarios, it is possible for the yachtsman or boater to visualize only the "green" indication and carelessly fail to recognize the "red" indication. In such an event, the yachtsman or boater would mistakenly believe that the automatic inflator is in full operating condition.

In recognition of the possible confusion of separate status indicators, the United States Coast Guard has mandated that all 1F automatic inflators include a "single-point" status indicator that indicates the overall operating condition of the automatic inflator inclusive of the gas cylinder. U.S. Pat. No. 6,589,087, the disclosure of which is hereby incorporated by reference herein, complies with the Coast Guard requirement by providing an automatic inflator having an indication of full ready-condition via a single-point window. However, there presently exists a need for single-point indication of full ready-condition in connection with a manual inflator.

Therefore, it is an object of this invention to provide an improvement which overcomes the aforementioned inadequacies of the prior art programs and provides an improvement which is a significant contribution to the advancement of the manual inflator art.

Another object of this invention is to provide an inflator for inflating an inflatable article including a gas cylinder indicator for indicating the proper installation of a gas cylinder to the automatic inflator.

Another object of this invention is to provide an automatic inflator for inflating an inflatable article including a gas cylinder indicator that indicates the charged condition of the gas cylinder connected to the automatic inflator.

The foregoing has outlined some of the pertinent objects of the invention. These objects should be construed to me merely illustrative of some of the more prominent features and applications of the intended invention. Many of the beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purposes of summarizing this invention, the invention comprises a manual inflator having a status indicator that indicates whether a fully-charged, unspent gas cylinder has been installed on the inflator. The status indicator comprises a "single point" indicator having an indicator window that displays the color "green" when the automatic inflator is fully operational or the color "red" when the inflator is at least partially inoperable automatically due to the removal of the gas cylinder or due to the firing of the inflator resulting in a spent gas cylinder.

More particularly, the manual inflator comprises a body having a boss for receiving the gas cylinder and having the indicator window. A pierce pin assembly is reciprocatably mounted within a bore in the body. The pierce pin assembly comprises an actuator of a first color (e.g., "red") that is in alignment with at least a portion of the indicator window at least when a fully-charged gas cylinder is received in the boss, thereby allowing the first color to be visualized through the indicator window. The pierce pin assembly further comprises a cap of a second color (e.g. "green") that is in alignment with at least a portion of the indicator window at least when either a gas cylinder is not received in the boss or a non fully-charged gas cylinder is received in the boss.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be greatly appreciated by those skilled in the art that the conception and the specific embodiment disclosed may be readily utilized as a basis for modifying or designing other methods for carrying out the same purposes of the present invention. It should also be realized by those skilled in the art that such equivalent methods do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several figures.

DETAILED DESCRIPTION OF THE PREFERRED EMBODIMENT

Figure 1:
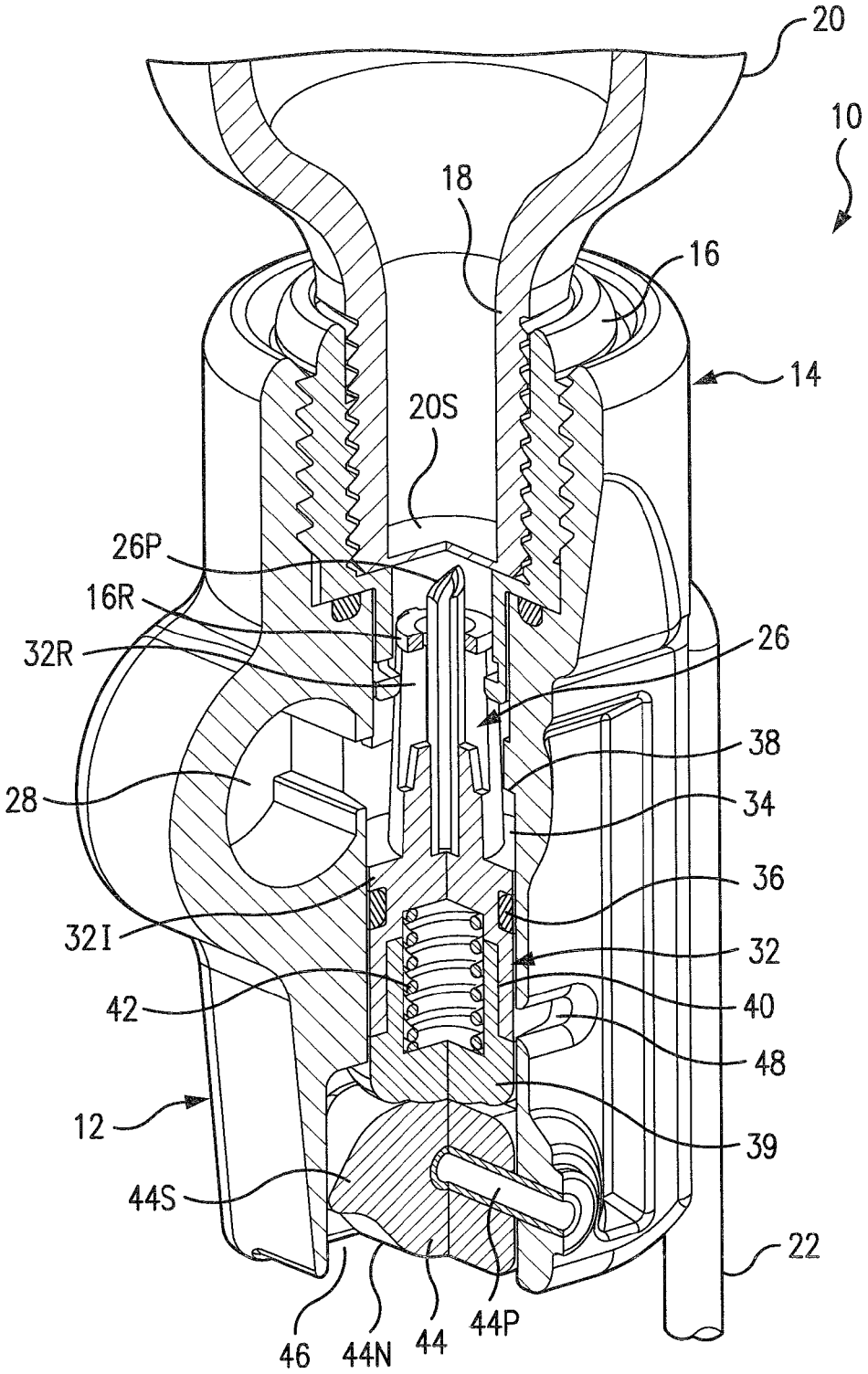
FIG. 1 is a three-quarter sectional view of the manual inflator of the invention and an installed gas cylinder in a ready condition with the "green" color of the actuator showing through the single-point status indicator window.

Referring to FIG. 1, the manual inflator 10 of the invention comprises a generally rectangular body 12 having a generally circular-cylindrical boss 14 with internal threads. A generally circular-cylindrical threaded collar 16 is permanently threadably connected onto the threaded neck 18 of a conventional gas cylinder 20. The collar 16 serves as a connector to threadably connect the gas cylinder 20 to the inflator 10 (and to prevent replacement use of other gas cylinders without such collars 16).

As described below, a lanyard 22 with a jerk handle 24 is operatively connected to a pierce pin assembly 26 reciprocably contained within the rectangular body 12 to pierce the frangible seal 20S of the gas cylinder 20 whereupon the escaping gas from the gas cylinder 20 flows out a conventional manifold 28 sealingly connected to the inflatable device to which the inflator 10 is installed, thereby inflating the device.

Figure 2:
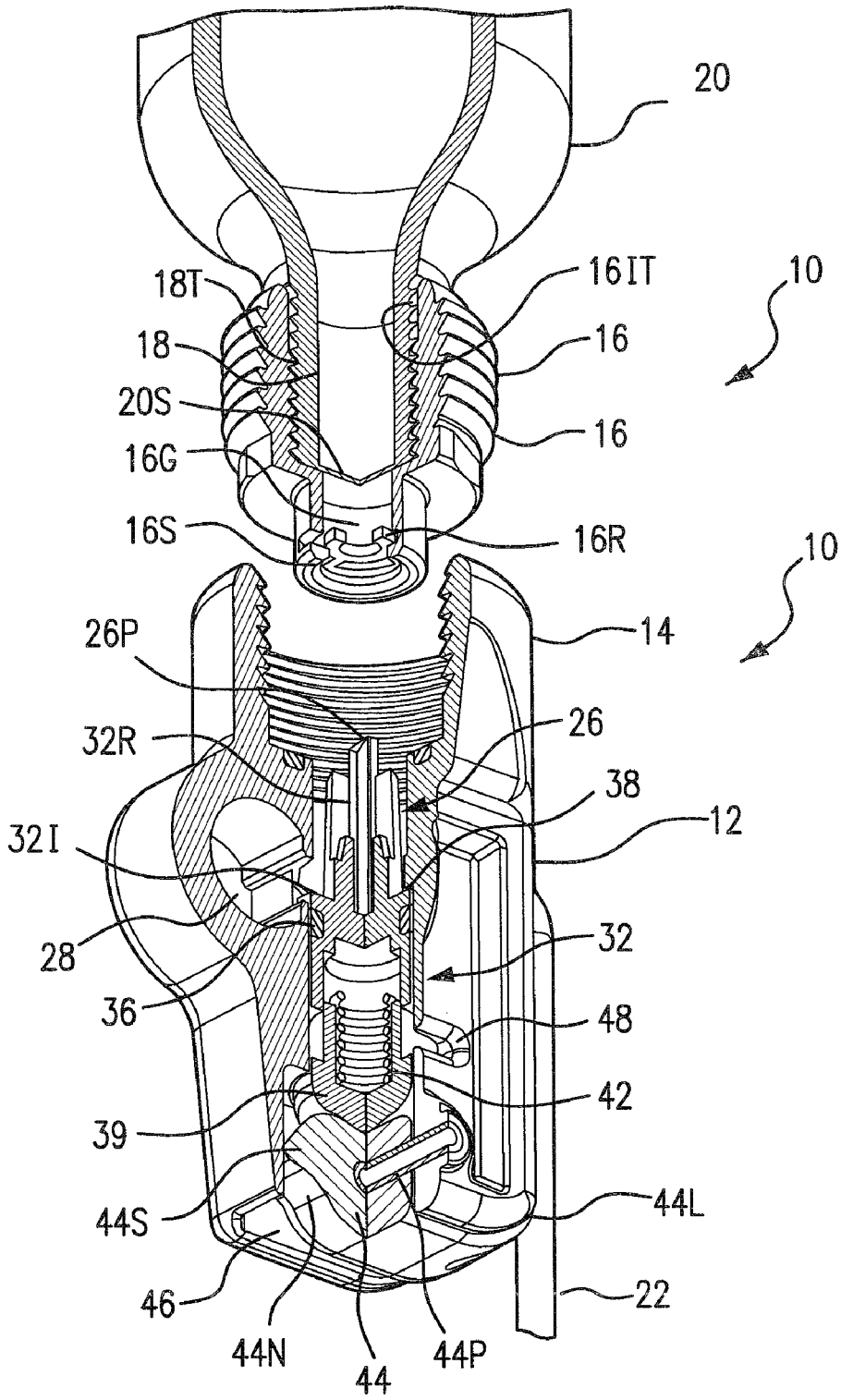
FIG. 2 is the same view as FIG. 1, but with the gas cylinder removed, illustrating a not-ready condition with the "red" color of the cap showing through the single-point status indicator window and illustrating the gas cylinder collar permanently factory-installed onto the threaded neck of the gas cylinder that threadably engages into the threaded boss of the manual inflator.
Figure 2A:
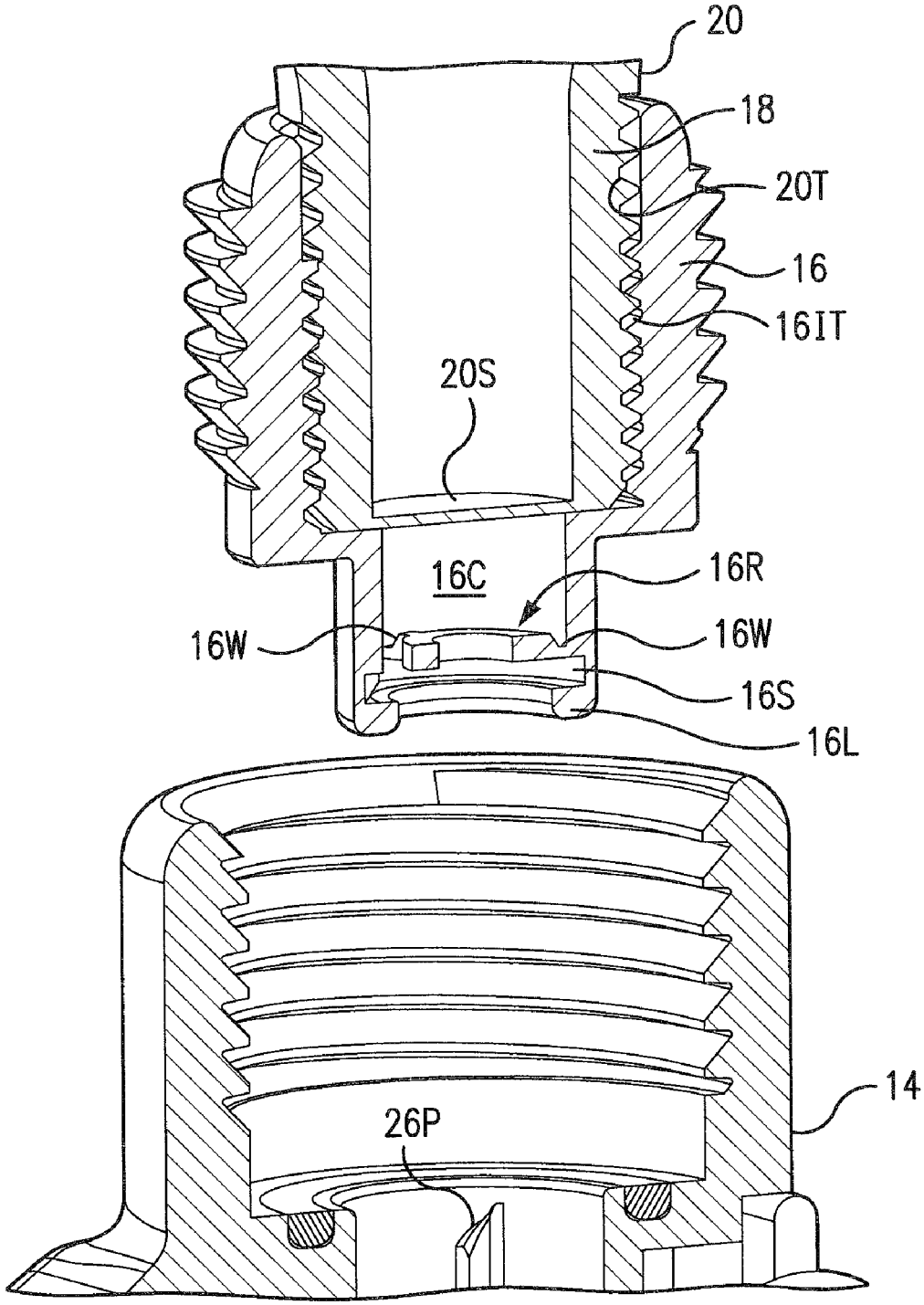
FIG. 2A is a partial cross-sectional, exploded view of the inflator and gas cylinder showing the break-ring of the gas cylinder collar on the neck of the gas cylinder that fractures upon firing of the inflator.

Referring to FIGS. 2 and 2A, the generally circular-cylindrical collar 16 having internal threads 16IT is threaded onto the threaded neck 20T of the gas cylinder 20. It is contemplated that the collar 16 will be permanently installed onto the neck 20T at the factory with a suitable thread adhesive such as TM "Loctite" and then the gas cylinder/collar assembly sold at retail. The collar 16 includes an integrally-formed, generally circular-cylindrical break-ring 16R formed within a cavity 16C via fracturable webs 16W extending from the annular edge of the break-ring 16R and the lumen of the wall of the cavity 16C. As explained below in more detail, the break-ring 16R breaks-off the collar 16 upon firing of the pierce pin assembly 26 and thereby functions as a sensor to sense when the gas cylinder 20 has been spent (or is missing). The cavity 16C includes an annular lip 16L to retain the break-ring 16R in the cavity 16C once broken off, thereby making sure it is discarded with the spent gas cylinder/collar 20/16.

The pierce pin assembly 26 comprises a pierce pin 26P rigidly mounted within the center of a reduced-diameter portion 32R portion of a generally circular-cylindrical actuator 32. The actuator 32 is reciprocatably mounted within a generally circular-cylindrical longitudinal bore 34 in the body 12 with its increased-diameter portion 32I being complementarily dimensioned for slidable engagement therewith. An O-ring seal 36 mounted onto the increased-diameter portion 32I provides a seal between the increased-diameter portion 32I of the actuator 32 and the bore 34. The forward travel (toward the gas cylinder 20) of the actuator 32 is limited by a stop 38 formed in the bore 34.

The pierce pin assembly 26 further includes a dome-shaped generally circular cylindrical indicator cap 39 mounted in a recess 40 formed in the rearward end of the increased-diameter portion 32I of the actuator 32. A spring 42 is entrained between the interior of the cap 39 and the interior of the recess 40 of the actuator 32 to constantly urge the two components apart.

Finally, the piece pin assembly 26 further comprises a generally L-shaped firing lever 44 with its short leg 44S pivotably mounted within a slot 46 formed in the upper end of the body 12 by a pivot pin 44P and with its longer leg 44L extending along the side of the body 12. The proximal end of the lanyard 22 is permanently affixed to the longer leg 44L such that upon jerking of the lanyard 22 via its jerk handle 24, the firing lever 44 pivots on the pivot pin 44P whereupon a cam surface 44C of the shorter leg 44S cams against the upper surface of the indicator cap 39 forcing it forward into the longitudinal bore 34.

For indicating the condition of the inflator 10, actuator 32 is preferably colored to indicate a "ready" condition (e.g., the color green) whereas cap 39 is preferably colored to indicate a "not-ready" condition (e.g., the color red) as may be viewed through an indicator window 48 formed through the wall of the body 12.

More specifically, FIG. 1 shows the inflator 10 in an armed, fully-ready condition with a gas cylinder 20 installed. In this condition, the tip of the reduced-diameter portion 32R of the actuator 32 is seated onto the break-ring 16R of the collar 16. As such, the pierce pin 26P is in close proximity to and aligned with the frangible seal 20S of the gas cylinder 20 and the spring 42 is compressed between the cap 39 and the actuator 32. It is noted that the spring force of the spring 42 is exerted against the cam surface 44C of the shorter leg 44S of the firing lever 44 to urge the longer leg 44L to a generally longitudinal position to be tucked along the body 12. In this condition, the green color of the actuator 32 is visible through the window 48 thereby indicating a fully-armed and ready condition of the inflator 10.

Figure 3:
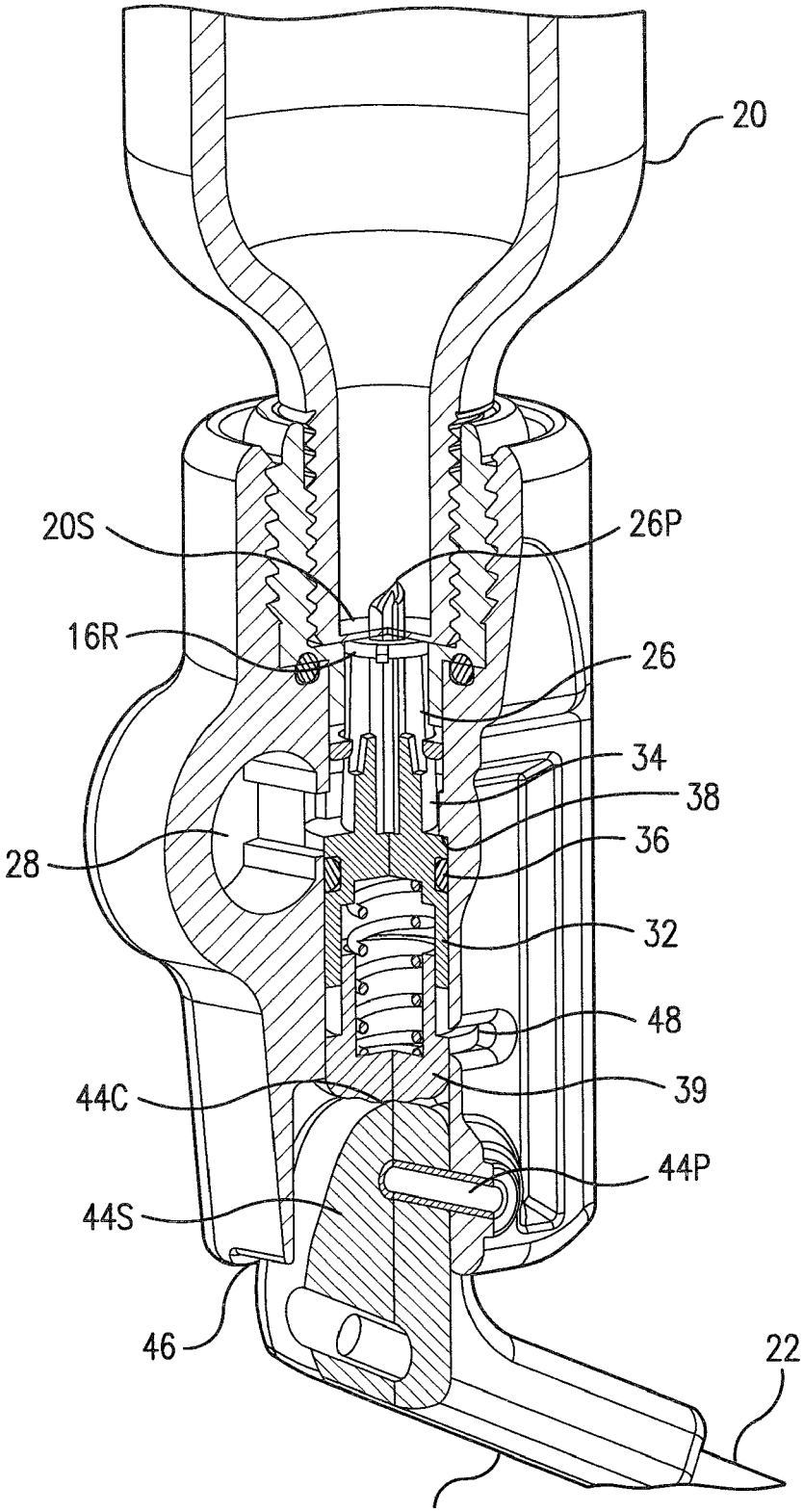
FIG. 3 is the same view as FIG. 3, but with the firing lever being pulled to its fully-fired position, illustrating the pierce pin having pierced the frangible seal of the gas cylinder and illustrating the "red" color of the cap showing through the single-point indicator window.
Figure 3A:
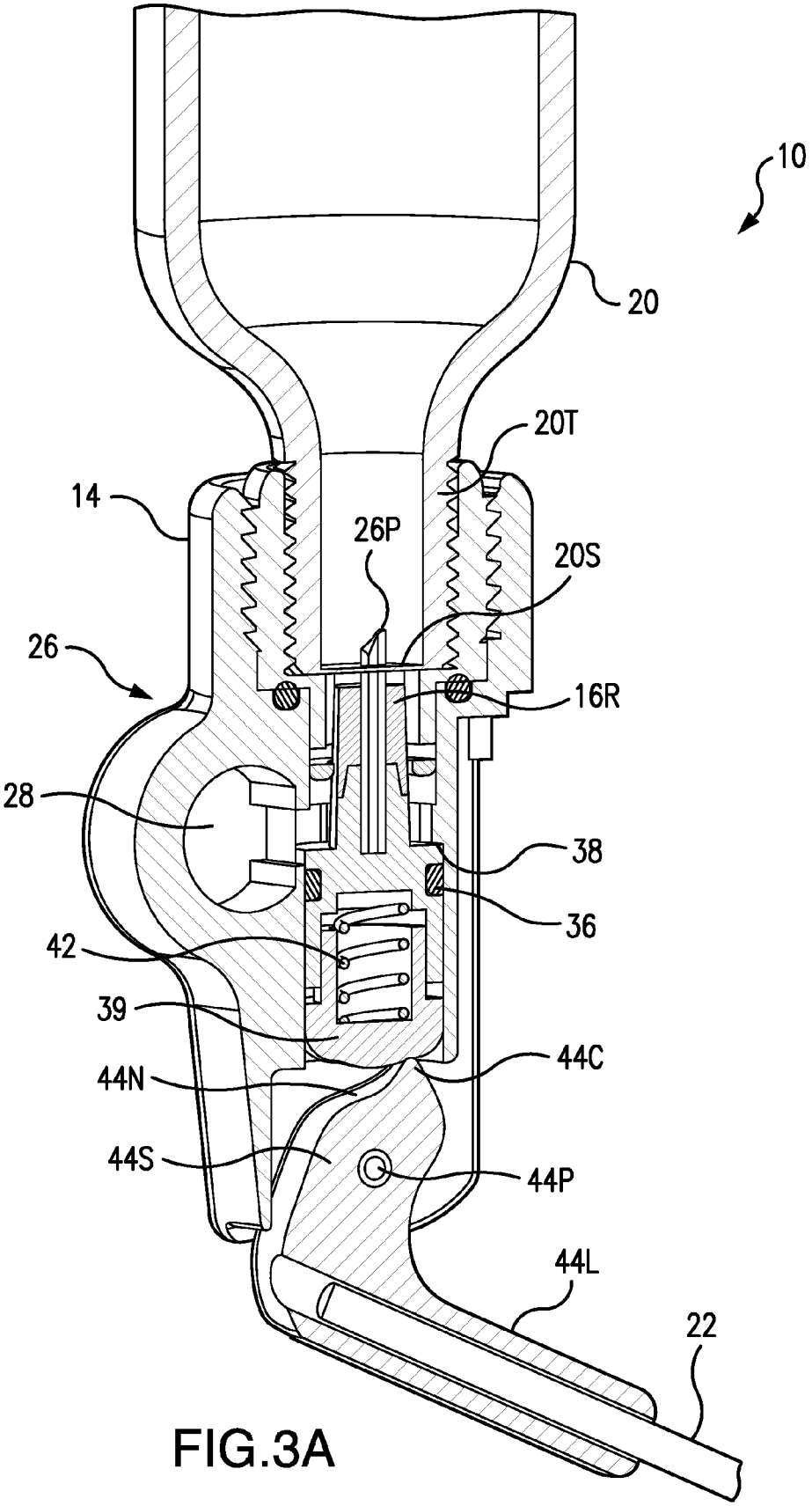
FIG. 3A is the same view as FIG. 3, but with the firing lever being partially pulled to its fully-fired position, illustrating the cam surface of the firing level caming against the cap.

FIG. 3 shows a not-ready condition after pulling of the lanyard 22. More specifically, as the lanyard 22 is pulled (see FIG. 3A), the firing lever 44 pivots on pivot pin 44P causing the cam surface 44C of its shorter leg 44S to cam against the upper surface of the cap 39 forcing it forwardly in the bore 34. Since the cap 34 is fully seated within the recess 40 of the actuator 32, the actuator 32 is likewise forced forwardly in the bore 34 whereupon the break-ring 16R is broken-off allowing the pierce pin 26P to be forced through the frangible seal 20S of the gas cylinder 20. The gas from the gas cylinder 20 then flows into the device via manifold 28. O-ring 36 prevents any escape of the gas out the bore 34.

In this condition with an installed but spent gas cylinder 20, the cap 39 is at the level of the indicator window 48 (i.e., protruding substantially out of the recess 40 with the actuator 32 more fully forward). Therefore, the red color of the cap 39 is visible through the window 48 thereby indicating a not-ready condition indicative of an installed but spent gas cylinder 20.

Figure 4:
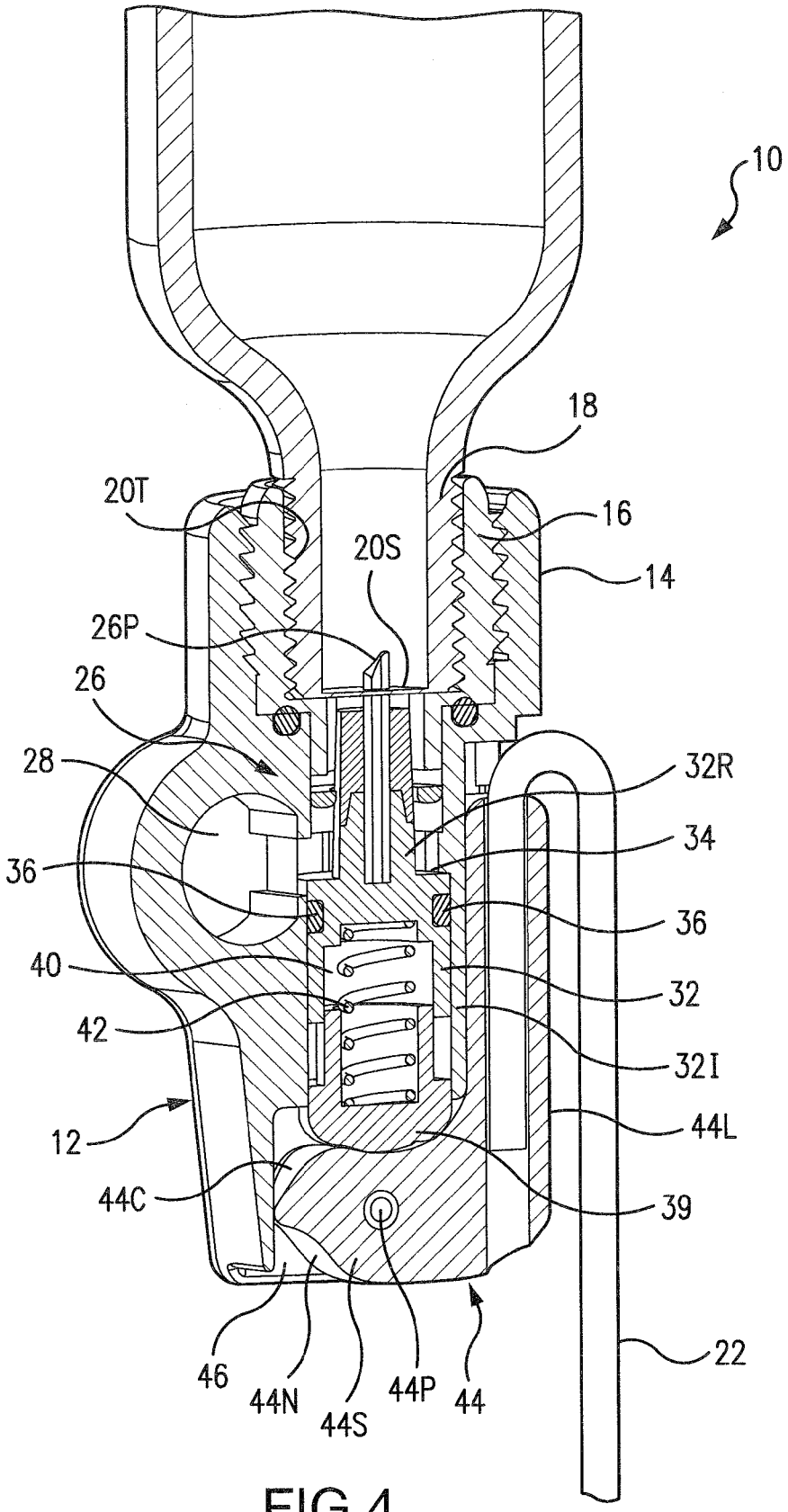
FIG. 4 is a longitudinal cross-sectional view of the manual inflator showing a not-ready condition after pulling of the lanyard causing the pierce pin to pierce the frangible seal of the gas cylinder.
Figure 5:
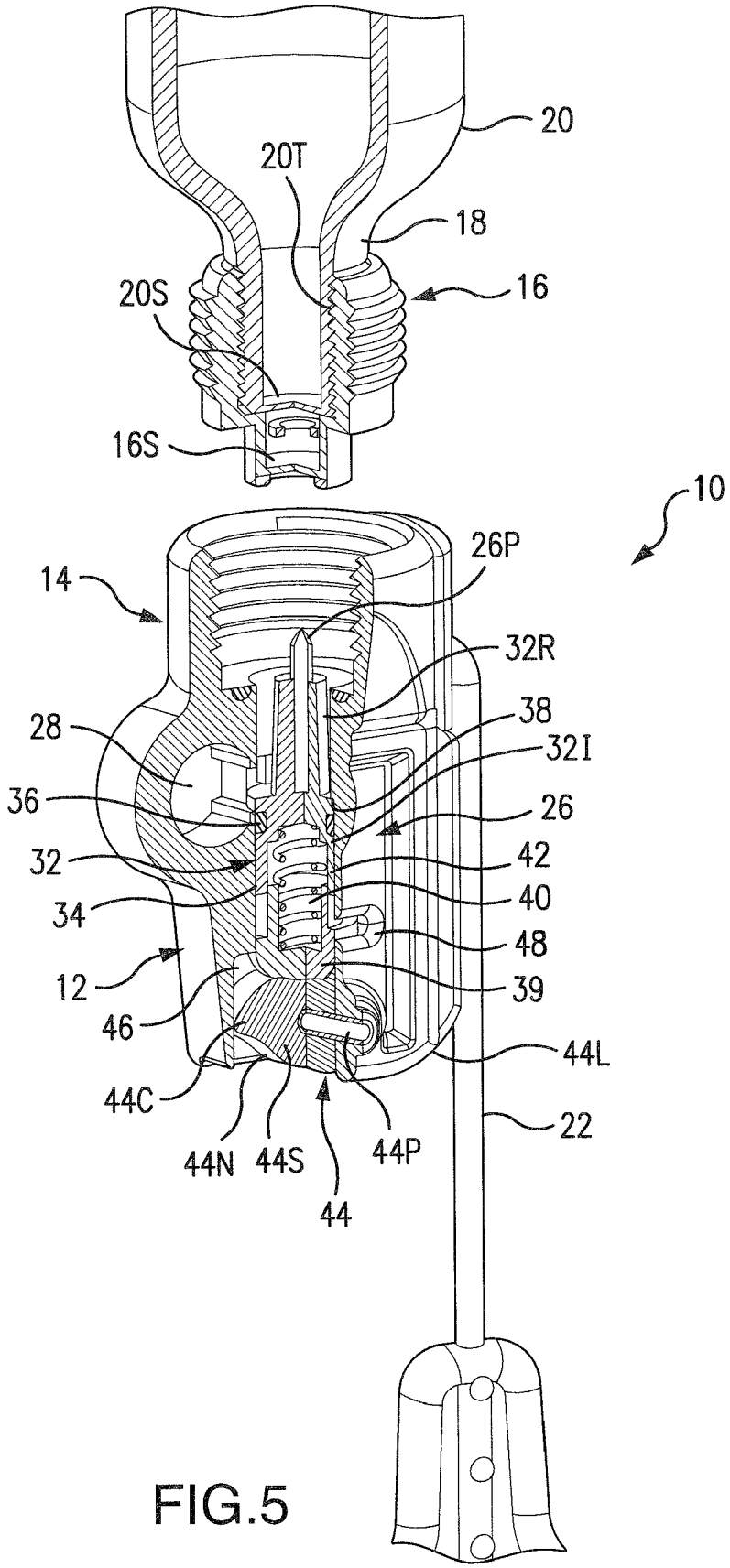
FIG. 5 is a three-quarter sectional view of the manual inflator with the gas cylinder removed, illustrating the broken-off break-ring in the cavity of the collar of the gas cylinder and illustrating the "red" color of the cap still showing through the single-point indicator window as the firing lever is returned to its at rest position.

As shown in FIGS. 4 and 5 as compared with FIG. 1, as the firing lever 44 is returned to its non-fired position (FIGS. 2 and 3), the spring 42 moves the cap 34 rearwardly out of the recess 40 while continuing to urge the actuator 32 forwardly, thereby assuring that the red color of the cap 34 remains exposed in the window 48.

Upon removal of the spent gas cylinder 20 as shown in FIG. 5, the now broken-off break-ring 32R remains entrained within the cavity 16C of the collar 16 since its diameter (inclusive of webs 32W) is larger than the diameter the lip 16L formed about the opened end of the cavity 16C. The spent gas cylinder 20 with its collar 16 (and entrained break-ring 16R) may then be discarded and a new one installed.

Figure 6:
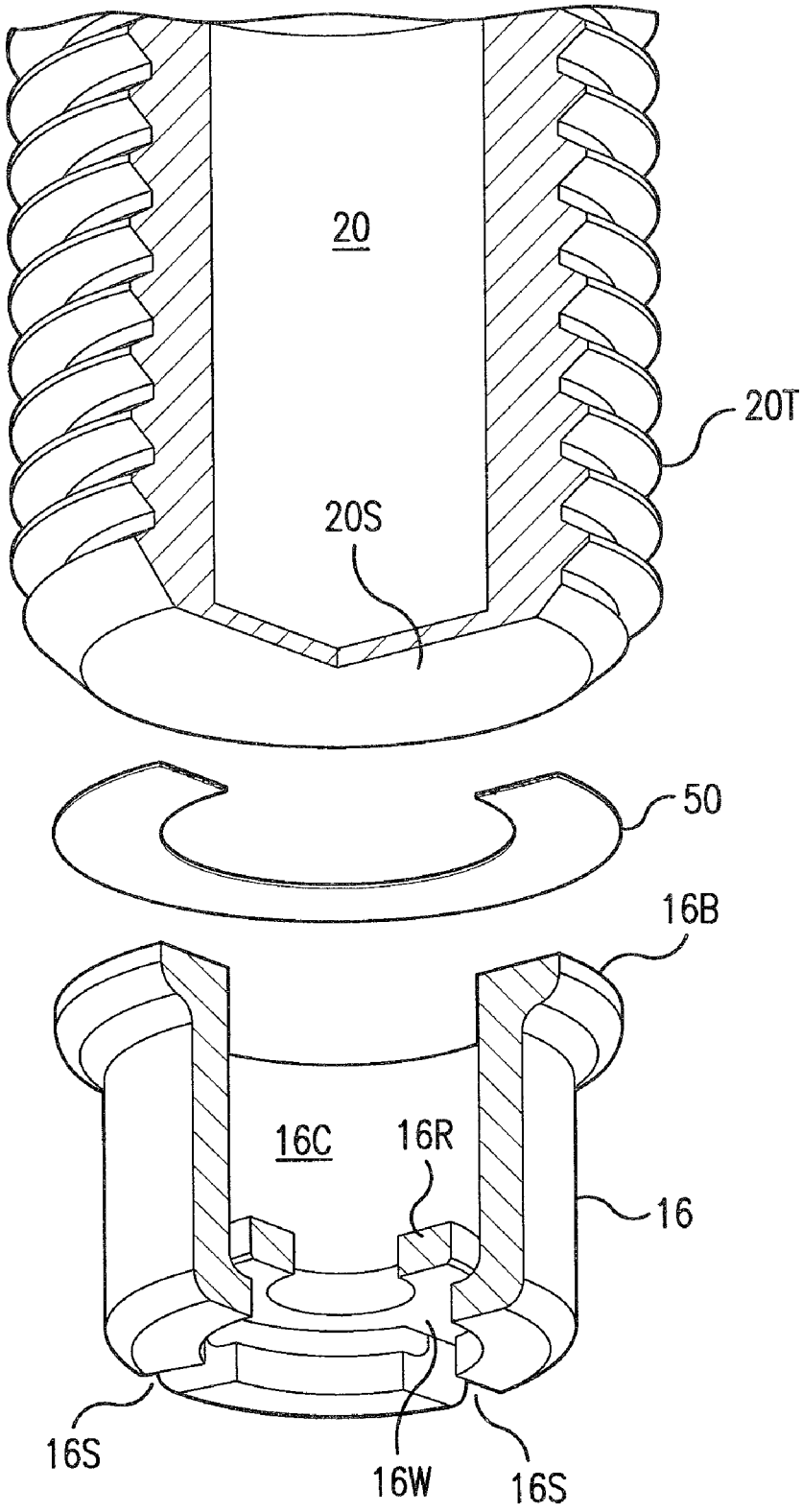
FIG. 6 is an exploded, three-quarter section view of a collar 16 that is intended to be adhered to the tip of the cylinder 20 by means of an adhesive.
Figure 7:
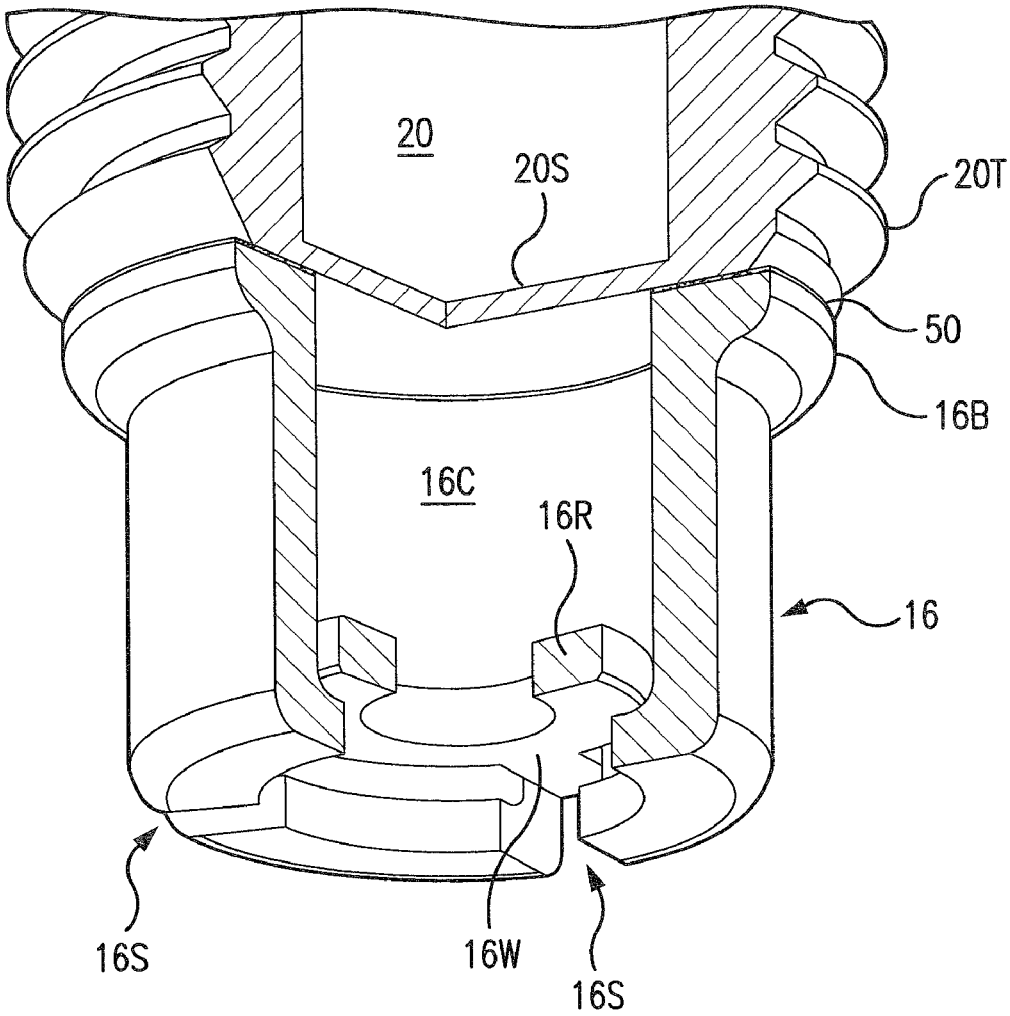
FIG. 7 is an assembled view of FIG. 6.

It is noted that in order to integrally form the break-ring 16R during injection molding, the injection mold includes retractable pins that are inserted sideways into the cavity 32C thereby ultimately forming slots 16S through the side wall of the cavity 16C after injection molding (see FIGS. 6 and 7).

Comparing FIG. 2 with FIG. 1, as a new gas cylinder 20 having a collar 16 according to the present invention, is threadably installed into the threaded boss 14, the break-ring 16R engages against tip of the reduced-diameter portion 32R of the actuator 32 forcing it rearwardly. As the actuator 32 is forced rearwardly, the wall of its recess 40 slides over the indicator cap 39 thereby concealing the red color of the indicator cap 39. With the actuator 32 now at the level of the indicator window 48, the color green of the actuator 32 is now visible through the indicator window 48, indicating a fully-armed and at-ready condition of the inflator 10.

It is evident from FIG. 5 that in the event a spent gas cylinder 20 is installed, the previously broken-off break-ring 16R of its collar 16, fails to move the actuator 32 rearwardly. The wall of its recess 40 therefore fails to slide rearwardly over and thereby telescope over or otherwise encompass the indicator cap 39. As shown in FIG. 4, the "red" color of the indicator cap 39 therefore remains visible through the indicator window 48.

Conversely, when a gas cylinder 20 with a good break-ring 16R is threaded into the boss 14 of the body 12 (see FIG. 2), the break-ring 16R forces the actuator 32 rearwardly whereupon its wall of its recess 32R telescopes over the indicator cap 39, thereby concealing the viewing of the red indicator cap 39 through the window 48 (see FIG. 1). Consequently, in this condition the green color of the actuator 32 is visible through the window 48 instead of the red color of the indicator cap 39, thereby indicating a fully charged and armed inflator 10.

FIG. 6 illustrates an alternative embodiment of the collar 16 that is intended to be adhered to the tip of the cylinder 20 by means of an adhesive 50. Adhesive 50 may comprise any suitable industrial-strength adhesive that is sufficiently strong to adhere the annular base 16B of the collar 16 to the annular periphery of the tip of the cylinder 20 about its frangible seal 20S. As in the other embodiment, the "glue-on" collar 16 comprises an interior cavity 16C having a break-ring 16R bordered by a plurality of fracturable webs 16W. Slots 16S extend longitudinally along the axis of the collar 16 allowing injection molding of the webs 16W through the use of retractable pins during injection molding. Preferably, in lieu of an equidistant angular arrangement (e.g., 120 degrees), the webs 16W are formed at non-symmetric angles (e.g., 110 degrees, 120 degrees and 130 degrees) so as to make it more unlikely that the break-ring 16R once broken off into the cavity 16C, will not reorient relative to the slots 16S to fall out of the cavity 16C once entrained therein.

Figure 8:
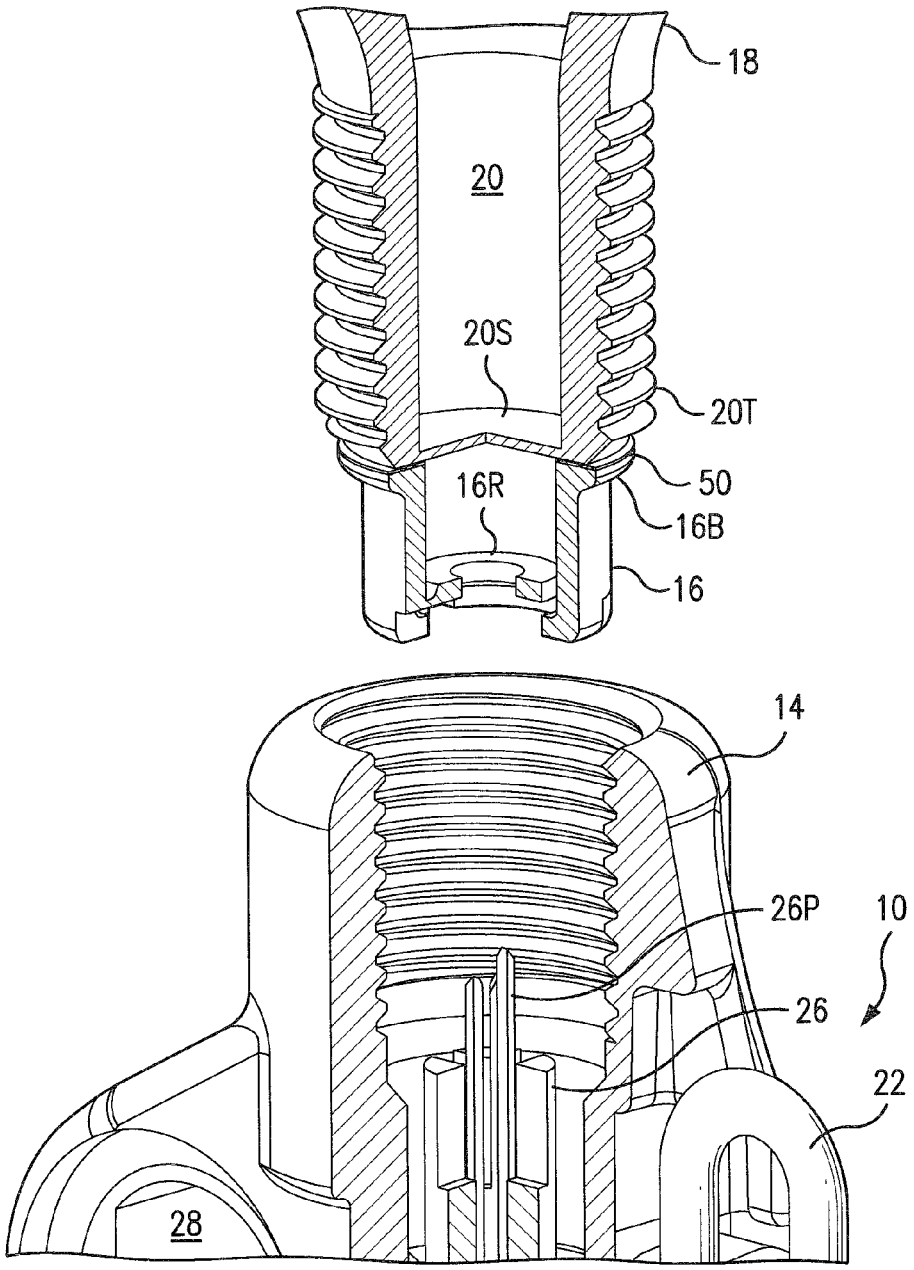
FIG. 8 is an exploded view of the assembled glue-on collar of FIGS. 6 and 7 dimensioned for fitting into the inflator of the invention.

As shown in FIG. 7, the outer diameter of the base 16B of the collar 16 is appreciably smaller than the diameter of the bottommost trough of the thread 20T of the cylinder 20 so as to not interfere with the threaded engagement of the threads 20T of the cylinder 20 into the threaded boss 14 of the inflator 10. The outer cylindrical surface of the collar 16 need not be threaded as in the case of the first embodiment of the collar (FIGS. 1-5) because of the fact that it is the threads 20T of the cylinder 20 that engages into the threaded boss 14 as shown in FIG. 8. Indeed, the threaded boss 14 may be conventionally threaded to receive the standardized threads of conventional cylinders 20 (e.g. ½-20 or ¾-24 threaded cylinders.)

Figure 9:
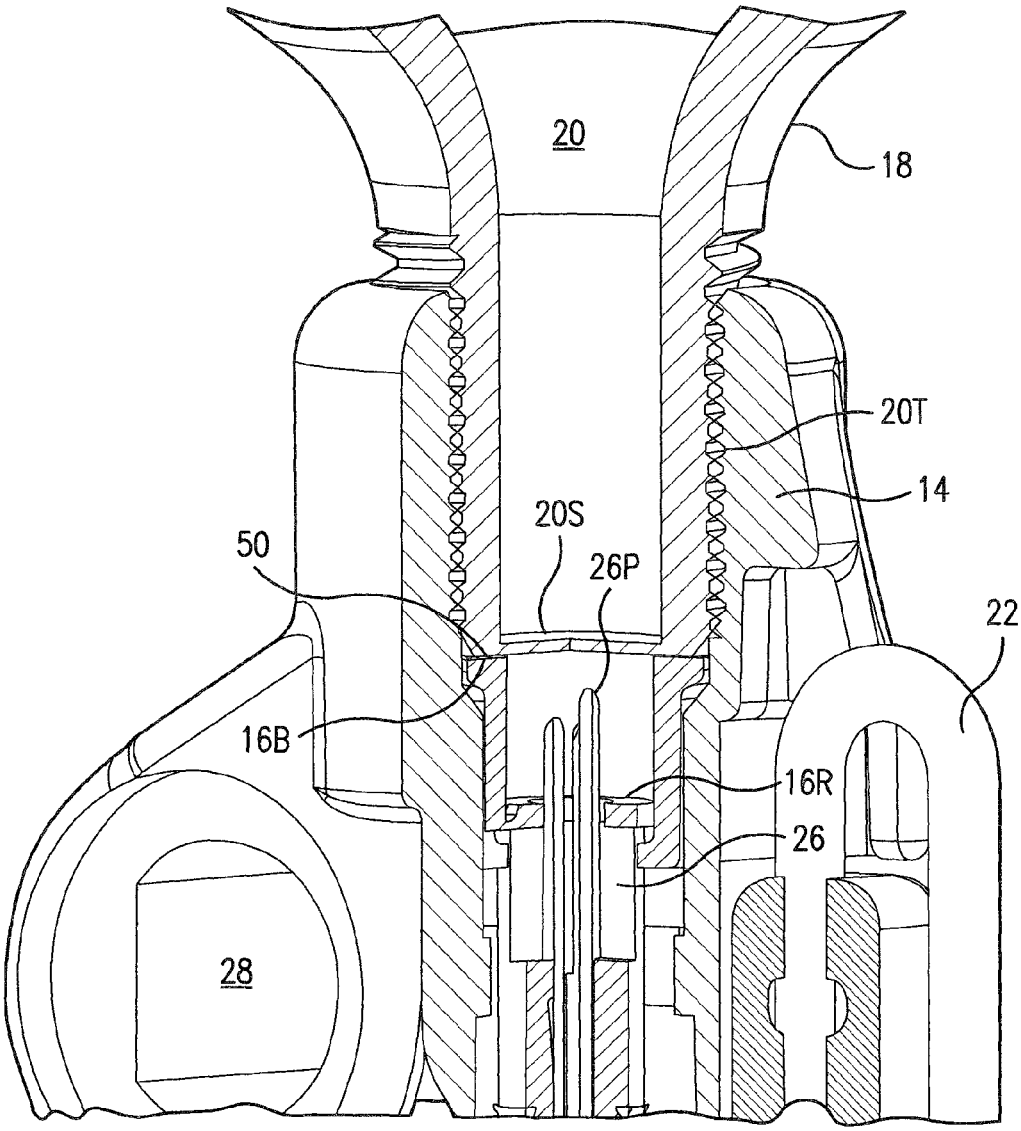
FIG. 9 is a three-quarter section view of the glue-on collar and threaded neck of the cylinder fully fitted into the inflator.

Finally, as shown in FIG. 9, once the gas cylinder 20 with the glue-on collar 16 is fully threaded into the threaded boss 14 of the inflator 12, the collar 16 functions the same as that described in connection with the other embodiment of the collar 16 (FIGS. 1-5) wherein the tip of the reduced-diameter portion 32R of the actuator 32 is seated onto the break ring 16R of the collar 16 and wherein the pierce pin 16P is in close proximity to be aligned with the frangible seal 20S of the gas cylinder 20. Then, after pulling on the lanyard 22 as described above, the actuator 32 is forced forwardly in the bore 34 whereupon the break-ring 16R is broken off by allowing the pierce pin 26P to force through the frangible seal 20S of the gas cylinder 20.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A manual inflator, comprising in combination:

a body having a boss for receiving a gas cylinder and having an indicator window; and a pierce pin assembly reciprocatably mounted within a bore in said body, said pierce pin assembly comprising an actuator of a first color that is in alignment with at least a portion of said indicator window at least when a fully-charged gas cylinder is received in said boss allowing the first color to be visualized through said indicator window and a cap of a second color that is in alignment with at least a portion of said indicator window at least when either a gas cylinder is not received in said boss or a non fully-charged gas cylinder is received in said boss; a portion of said actuator covers a portion of said cap to conceal the second color at least when a fully-charged gas cylinder is received in said boss.

2. The manual inflator as set forth in claim 1, wherein said boss for receiving a gas cylinder further comprises a collar for connection of a neck of the gas cylinder to said boss.

3. The manual inflator as set forth in claim 2, wherein said collar comprises a break ring that maintains said portion of said pierce pin assembly to cover said portion of said cap when a fully-charged gas cylinder is received in said boss.

4. The manual inflator as set forth in claim 3, wherein said break-ring is broken off when the inflator is actuated manually whereupon said portion of said pierce pin assembly does not cover said portion of said cap.

5. The manual inflator as set forth in claim 4, wherein said collar and said neck are threadably coupled.

6. The manual inflator as set forth in claim 4, wherein said collar is adhered to said neck.

7. The manual inflator as set forth in claim 4, wherein said collar comprises a cavity with said break ring being connected therein by fracturable webs that break off when the inflator is actuated manually.

8. The manual inflator as set forth in claim 7, wherein said cavity includes an annular lip to retain the break ring in the cavity once broken off.

9. The manual inflator as set forth in claim 1, further including a spring entrained between said cap and said pierce pin assembly to constantly urge them apart.

10. The manual inflator as set forth in claim 1, wherein said piece pin assembly further comprises a generally L-shaped firing lever with a short leg pivotably mounted within a slot formed in an upper end of said body by a pivot pin, a longer leg extending along a side of said body and a cam surface, whereby said cam surface cams against a surface of said cap.

11. A method for indicating the operating condition of a manual inflator, comprising the steps of:

providing a body having a boss for receiving a gas cylinder and having an indicator window; and reciprocatably mounting a pierce pin assembly within a bore in said body, said pierce pin assembly comprising an actuator of a first color that is in alignment with at least a portion of said indicator window at least when a fully-charged gas cylinder is received in said boss allowing the first color to be visualized through said indicator window and a cap of a second color that is in alignment with at least a portion of said indicator window at least when either a gas cylinder is not received in said boss or a non fully-charged gas cylinder is received in said boss; a portion of said actuator covers a portion of said cap to conceal the second color at least when a fully-charged gas cylinder is received in said boss.

12. The method as set forth in claim 11, wherein said boss receiving a gas cylinder further comprises a collar for connection of a neck of the gas cylinder to said boss.

13. The method as set forth in claim 12, further comprising a break ring in said collar that maintains said portion of said pierce pin assembly to cover said portion of said cap when a fully-charged gas cylinder is received in said boss.

14. The method as set forth in claim 13, further comprising the step of breaking off said break-ring when the inflator is actuated manually whereupon said portion of said pierce pin assembly does not cover said portion of said cap.

15. The method as set forth in claim 14, further comprising the step of threadably coupling together said collar and said neck.

16. The method as set forth in claim 14, further comprising the step of adhering said collar to said neck.

17. The method as set forth in claim 14, further comprising the step of retaining said break ring within a cavity in said collar when the inflator is actuated manually.

18. The method as set forth in claim 17, wherein said step of retaining said break ring within said cavity comprises retaining by a an annular lip formed around said cavity.

19. The method as set forth in claim 18, further comprising the step of constantly urging said cap and said pierce pin assembly apart.

* * * * *